US006989726B2

(12) United States Patent
Amano

(10) Patent No.: US 6,989,726 B2
(45) Date of Patent: Jan. 24, 2006

(54) HIGH-FREQUENCY FILTER CIRCUIT AND HIGH-FREQUENCY COMMUNICATION DEVICE

(75) Inventor: Yoshihisa Amano, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/492,093

(22) PCT Filed: Oct. 3, 2002

(86) PCT No.: PCT/JP02/10322

§ 371 (c)(1),
(2), (4) Date: Apr. 9, 2004

(87) PCT Pub. No.: WO03/034534

PCT Pub. Date: Apr. 24, 2003

(65) Prior Publication Data

US 2004/0257174 A1 Dec. 23, 2004

(30) Foreign Application Priority Data

Oct. 12, 2001 (JP) ..... 2001-315268

(51) Int. Cl.
*H01P 1/203* (2006.01)

(52) U.S. Cl. ..... 333/204

(58) Field of Classification Search ..... 333/175, 333/185, 204, 205

See application file for complete search history.

(56) References Cited

U.S. PATENT DOCUMENTS 4,418,324 A 11/1983 Higgins
4,731,596 A * 3/1988 Cruchon et al. ..... 333/204

(Continued)

FOREIGN PATENT DOCUMENTS

JP 6-7315 U 1/1994

OTHER PUBLICATIONS

Hamaguchi et al., "A Wireless Video Home-link Using 60GHz Band: Cncept and Performance of the Developed System," 30th European Microwave Conference, pp. 293-296 (2000).

(Continued)

*Primary Examiner*—Seungsook Ham
(74) *Attorney, Agent, or Firm*—Birch, Stewart, Kolasch & Birch, LLP

(57) ABSTRACT

A high-frequency filter circuit comprises a first coupled transmission line system (G1) including a first line (TL1) having a line end (1A) serving as an input port (1) and a line end (1B) serving as an open end and second and third lines (TL2, TL3) provided on both sides of the first line (TL1) and a second coupled transmission line system (G2) including a first line (TL1) having line end (1A) serving as an output port (2) and a line end (1B) serving as an open end and second and third lines (TL2, TL3) provided on both sides of the first line (TL1). In the first and second coupled transmission line systems (G1, G2), the line ends (2B) of the second lines (TL2) and the line ends (3A) of the third lines (TL3) are open ends, and the line end (2A) of the second line (TL2) of one of the systems and the line end (3B) of the third line (TL3) of the other system are interconnected through phase lines (3, 4). Thus, a favorable filter characteristic of high steepness and low insertion loss can be obtained, and a high-frequency filter circuit easy to produce, suitable for MMIC, small, lightweight, and produced at low cost and a high-frequency communication device are provided.

6 Claims, 12 Drawing Sheets

U.S. PATENT DOCUMENTS

| | | | | |
|---|---|---|---|---|
| 6,215,374 | B1 * | 4/2001 | Petrovic | 333/204 |
| 6,559,741 | B2 * | 5/2003 | Takeda | 333/204 |
| 6,590,476 | B2 * | 7/2003 | Lee et al. | 333/204 |
| 6,627,992 | B2 * | 9/2003 | Ammar | 257/728 |

OTHER PUBLICATIONS

Konishi, "A Design and its Application of the Flilter Circuit Color for Communication," vol. 1, pp. 50-59.
Konishi, "A Design and its Application of the Flilter Circuit Color for Communication," vol. 1, pp. 50-59, Feb., 1994.

* cited by examiner

HIGH-FREQUENCY FILTER CIRCUIT AND HIGH-FREQUENCY COMMUNICATION DEVICE

This Nonprovisional application claims priority under 35 U.S.C. §119(a) on Patent Application No. P2001-315268 filed in Japan on Oct. 12, 2001, the entire contents of which are hereby incorporated by reference.

TECHNICAL FIELD

This invention relates to a high-frequency filter circuit and a high-frequency communication device, which is used particularly in a high-frequency band of millimeterwave band or the like and employs a high-frequency transmission line of a microstrip line, a coplanar line or the like.

BACKGROUND ART

Conventionally, as a high-frequency filter circuit, there is the high-frequency filter circuit managed as a distributed element circuit shown in FIG. 16. As shown in FIG. 16, this high-frequency filter circuit employs a microstrip line as a high-frequency transmission line that forms the basis of a distributed element. In FIG. 16, there are shown a dielectric substrate 85 of ceramic or the like, a GND pattern 86 on the lower surface of the dielectric substrate 85, an input line 81 which is provided on the dielectric substrate 85 and whose one end serves as an input port, an output line 82 which is provided on the dielectric substrate 85 and whose one end serves as an output port, and λ/2 resonators 84*a* and 84*b*. The λ/2 resonators 84*a* and 84*b* are microstrip lines whose length is designed roughly to λ/2 with respect to the wavelength λ of the center frequency of the filter, and their both ends are open ends. There are also shown a gap 87*a* provided between the input line 81 whose one end is the input port and the λ/2 resonator 84*a,* a gap 87*b* provided between the output line 82 whose one end is the output port and the λ/2 resonator 84*b,* and a gap 88 provided between the λ/2 resonator 84*a* and the λ/2 resonator 84*b*.

The above kind of high-frequency filter circuit, which is able to form a filter circuit of printed wiring of only one layer and excellent in terms of productivity and cost, has often been used in the frequency band of about 5 to 30 GHz. Furthermore, in recent years, the filter circuit has been used also in the millimeterwave band of 30 to 60 GHz.

FIG. 17 shows the equivalent circuit of the high-frequency filter circuit shown in FIG. 16. In FIG. 17, there are shown capacitors C51, C52 and C53 and an inductor L51. It is generally known that the filter characteristic of this high-frequency filter circuit becomes as shown in FIGS. 18 and 19. In FIGS. 18 and 19, the reference numeral S11 denotes a parameter that represents a reflection coefficient, and the reference numeral S21 denotes a parameter that represents a transmission coefficient. FIG. 18 is a graph of a wide band, and FIG. 19 is a graph in which the portion including the passband and the attenuation band is enlarged. In this case, the capacitor C51 is 0.03661 pF, the capacitor C52 is 0.05270 pF, the capacitor C53 is 0.02884 pF, and the inductors L51 and L52 are each 0.01699 nH. In FIG. 19, the passband and the attenuation band (unnecessary wave band) of the required filter specifications are indicated by hatched lines in the case where there is supposed an application of removing the unnecessary wave band (image band attributed to the mixer) set at 55 to 57 GHz with the passband of the filter set at 60 to 62 GHz for the sake of comparison with the graph of the high-frequency filter circuit of this invention described later.

Although several graphs are hereinafter inserted in the present specification, the three kinds of graphs of simulation results by an equivalent circuit of a lumped element, simulation results by a distributed element equivalent circuit and measurement results of actually conducted experiments exist in mixture inevitably for convenience in explanation. Among others, the simulation results centered on a lumped element as in FIGS. 18, 19 and 10 are to clarify the principle of operation of a circuit, and no consideration is provided for loss in the circuit elements. Therefore, insertion loss is calculated underestimated. In the prior art high-frequency filter circuit of FIG. 16, even a minimum insertion loss in the microwave band, in which the frequency is comparatively low, generally amounts to about 2 to 3 dB though it is changed depending on the bandwidth and attenuation.

The aforementioned high-frequency filter circuit has a first problem that steepness in the filter characteristic is low particularly when used in a superhigh frequency band like the millimeterwave band. In general, the most striking feature in the specifications required for the filter circuit of the millimeterwave band resides in its steepness. For example, reference is made to a radio communication device of 60-GHz band taken as an example. Even in the radio communication device of 60-GHz band, signal processing in the IF circuit is usually performed in a low frequency band of about 1 to 2 GHz. Subsequently, by being mixed with a local signal of, for example, 59 GHz, the signal is finally upconverted to the millimeterwave band of 60 to 61 GHz. Here is considered the filter specifications required when image rejection is effected by a millimeterwave band filter in such a radio communication device. When the signal is upconverted to the millimeterwave band of 60 to 61 GHz, the image band is located in the position of 57 to 58 GHz. That is, the 58-GHz band located only 2 GHz away from the passband of 60 GHz becomes the inhibition zone, and this means that the frequency interval has a separation of only about 2÷60= 3.3% in terms of a ratio with respect to the band. Accordingly, there is required extremely high steepness such that the signal is attenuated by a minimum of about 15 dB within the interval of the ratio of only about 3% with respect to the band as a filter specification.

However, in the case of the prior art high-frequency filter circuit of FIG. 16, there can be achieved only the bandpass characteristic of gentle slopes as is apparent from the graphs of FIGS. 18 and 19, and high steepness cannot be obtained. In the case of such a filter circuit, there is known the method of increasing the number of stages of the circuit, i.e., increasing the number of λ/2 resonators in order to increase the steepness. However, the above method practically has a slight improvement of steepness in the vicinity of the passband, and there is an adverse effect that the following second and third problems described below disadvantageously increase, lacking practicability.

As the second problem of the aforementioned high-frequency filter circuit, there is a problem that insertion loss is large. It is generally known that the parasitic loss of the circuit sharply increases in the superhigh frequency band like the millimeterwave band. Particularly, in the case of the high-frequency filter circuit shown in FIG. 16, it can easily be estimated that this parasitic loss becomes significant according to its structure. An electric signal entering from the input port of the input line 81 appears at the output port of the output line 82 after it passes all the way through a long path extended from the gap 87*a,* the λ/2 resonator 84*a,* the gap 88, the λ/2 resonator 84*b* and the gap 87*b*. Through this path, a conductor loss, a radiation loss and a dielectric loss are generated and added up in the gaps 87*a,* 88 and 87*b* and the resonators 84*a* and 84*b*. That is, the structure in which the series signal path is extremely long itself has the cause of the unavoidable loss increase.

Further, as the third problem of the high-frequency filter circuit, there is the problem that the circuit area is large. In the superhigh frequency band like the millimeterwave band, it is known that reducing the parts count and the number of connection portions between circuits by integrating a plurality of circuits into one chip on an MMIC (Monolithic Microwave Integrated Circuit) is a very effective method in terms of both an improvement in the electrical performance and an improvement in the manufacturing cost. The same thing can be said for the high-frequency filter circuit, and there is a great need for integrating the filter circuit with the amplifier circuit and the mixer circuit connected before and behind the circuit into one chip on an MMIC. On the other hand, it is required to reduce the circuit area in order to reduce the chip cost of the MMIC. In the case of the high-frequency filter circuit shown in FIG. 16, there is a drawback that the dimension particularly in the direction A in FIG. 16 disadvantageously becomes extremely long since it has the structure in which the input line 81, the $\lambda/2$ resonator 84*a*, the $\lambda/2$ resonator 84*b* and the output line 82 are connected in series. Even in the millimeterwave band in which the wavelength $\lambda$ is short, it is normal that the $\lambda/2$ dimension is about 1 mm in, for example, the 60-GHz band. From the viewpoint of the dimensions of a millimeterwave-band MMIC that often has in general a size of about 1 to 2 mm square, the size A of FIG. 16 disadvantageously becomes an unacceptable large size.

Moreover, as a prior art high-frequency. communication device, there is the millimeterwave band communication device shown in FIG. 20. As shown in FIG. 20, this millimeterwave band communication device is provided with two mixers 91 and 92 into which a TV signal is inputted, a local oscillator 93 that supplies a local signal to the mixers 91 and 92, an amplifier (hereinafter referred to as an amp) 94 that amplifies the output signals outputted from the two mixers 91 and 92 and an antenna 95 to which the output of the amp 94 is connected. The two mixers 91 and 92 constitute a balance type mixer 90.

For the purpose of image rejection in the millimeterwave band communication device shown in FIG. 20, there has often been used not a filter but a balance type image rejection mixer. This is because it has been difficult to obtain a filter of excellent steepness in the millimeterwave band. However, the balance type image rejection mixer generally has a drawback that the bandwidth is narrow, and it has been difficult to meet the requirements of the TV signal transmission system that has a bandwidth of up to 2 to 3 GHz by only the balance type image rejection mixer (refer to the reference document of K. Hamaguchi et al., "A Wireless Video Home-Link Using 60 GHz Band: A Concept of Developed System", Proc. of EuMC, vol.1, pp.293–296, 2000"). Moreover, in the case where the balance type image rejection mixer is employed, it is usual that the chip area is increased double or more in comparison with that of the ordinary mixer circuit that is not the balance type. Accordingly, there are the problems of an increase in the chip unit cost and difficulties in attempting to integrate other circuits (amp circuit and so on) on an identical chip any further.

Furthermore, as another prior art high-frequency communication device, there is the millimeterwave band communication device shown in FIG. 21. As shown in FIG. 21, this millimeterwave band communication device is provided with a mixer 101 into which a TV signal is inputted, a local oscillator 102 that supplies a local signal to the mixer 101, a filter 103 that effects image rejection of the signal outputted from the mixer 101, an amp 104 that amplifies the signal outputted from the filter 103 and an antenna 105 to which the output of the amp 104 is connected.

For the purpose of image rejection in the millimeterwave band communication device shown in FIG. 21, it has often been the case where a waveguide filter has been used as the filter 103 capable of obtaining high performance also in the millimeterwave band. However, in this case, there have been the drawbacks of difficulties in electrical connection between the waveguide and the MMIC as well as the expensiveness, large size and heavy weight of the waveguide filter itself.

DISCLOSURE OF THE INVENTION

Accordingly, the object of this invention is to provide a high-frequency filter circuit and high-frequency communication device, which is able to obtain a favorable filter characteristic of high steepness and low insertion loss and is easy to produce, suitable for MMIC, small, lightweight and produced at low cost.

In order to achieve the above object, there is provided a high-frequency filter circuit comprising:

a first coupled transmission line system having an input side first line whose one line end serves as an input port and the other line end serves as an open end, an input side second line and an input side third line, which are arranged on both sides of the input side first line; and a second coupled transmission line system having an output side first line whose one line end serves as an output port and the other line end serves as an open end, an output side second line and an output side third line, which are arranged on both sides of the output side first line, the input side second line having an open end at a line end located on same side as that of the open end side of the input side first line, the input side third line having an open end at a line end located on same side as that of the input port side of the input side first line, the output side second line having an open end at a line end located on same side as that of the open end side of the output side first line, the output side third line having an open end at a line end located on same side as that of the output port side of the output side first line, a line end located on the input port side of the input side second line of the first coupled transmission line system being connected to a line end located on the side opposite from the output port side of the output side third line of the second coupled transmission line system, and a line end located on the output port side of the output side second line of the second coupled transmission line system being connected to a line end located on the side opposite from the input port side of the input side third line of the first coupled transmission line system.

According to the high-frequency filter circuit of the above-mentioned construction, the portion of the connection between the line end located on the input port side of the input side second line of the first coupled transmission line system and the line end located on the side opposite from the output port side of the output side third line of the second coupled transmission line system as well as the portion of the connection between the line end located on the output port side of the output side second line of the second coupled transmission line system and the line end located on the side opposite from the input port side of the input side third line of the first coupled transmission line system operate as a $\lambda/2$ resonator. Then, the frequency band, in which this $\lambda/2$ resonator causes resonance, serves as the passband of the filter, and a steep bandpass characteristic having transmission zeros in the vicinity of both sides of the passband, is obtained. As described above, since the two λ/2 resonators are connected to each other not in series but parallel between the input and output ports, the whole circuit can be reduced in size. In addition, since a steep bandpass characteristic can be obtained, there is no need to increase the size of the filter circuit with a multi-stage structure. Accordingly, there can be provided a high-frequency filter circuit, which is able to obtain a favorable filter characteristic of high steepness and low insertion loss and is easy to produce, suitable for MMIC, small, lightweight and produced at low cost.

In one embodiment of the present invention, at least one of electromagnetic field coupling between the input side first line and the input side second line of the first coupled transmission line system and electromagnetic field coupling between the output side first line and the output side second line of the second coupled transmission line system is replaced by mutual inductance.

According to the high-frequency filter circuit of the above-mentioned construction, there can be provided a high-frequency filter circuit, which is able to obtain a favorable filter characteristic of high steepness and low insertion loss and is easy to produce, suitable for MMIC, small, lightweight and produced at low cost.

In one embodiment of the present invention, at least one of electromagnetic field coupling between the input side first line and the input side third line of the first coupled transmission line system and electromagnetic field coupling between the output side first line and the output side third line of the second coupled transmission line system is replaced by capacitance.

According to the high-frequency filter circuit of the above-mentioned construction, there can be provided a high-frequency filter circuit, which is able to obtain a favorable filter characteristic of high steepness and low insertion loss and is easy to produce, suitable for MMIC, small, lightweight and produced at low cost.

In one embodiment of the present invention, at least one of the connection for connecting the line end located on the input port side of the input side second line of the first coupled transmission line system to the line end located on the side opposite from the output port side of the output side third line of the second coupled transmission line system and the connection for connecting the line end located on the output port side of the output side second line of the second coupled transmission line system to the line end located on the side opposite from the input port side of the input side third line of the first coupled transmission line system is replaced by inductance.

According to the high-frequency filter circuit of the above-mentioned embodiment, there can be provided a high-frequency filter circuit, which is able to obtain a favorable filter characteristic of high steepness and low insertion loss and is easy to produce, suitable for MMIC, small, lightweight and produced at low cost.

Also, there is provided a high-frequency communication device, wherein the above high-frequency filter circuit is formed integrally with another circuit as an image rejection filter on an MMIC.

According to the above high-frequency communication device, the entire system can be fabricated into an MMIC. Therefore, it becomes possible not only to produce the single unit of the filter circuit at low cost with a small size and light weight but also to largely simplify the entire system, reduce the parts count and simplify the manufacturing processes.

BEST MODE FOR CARRYING OUT THE INVENTION

Figure 1:
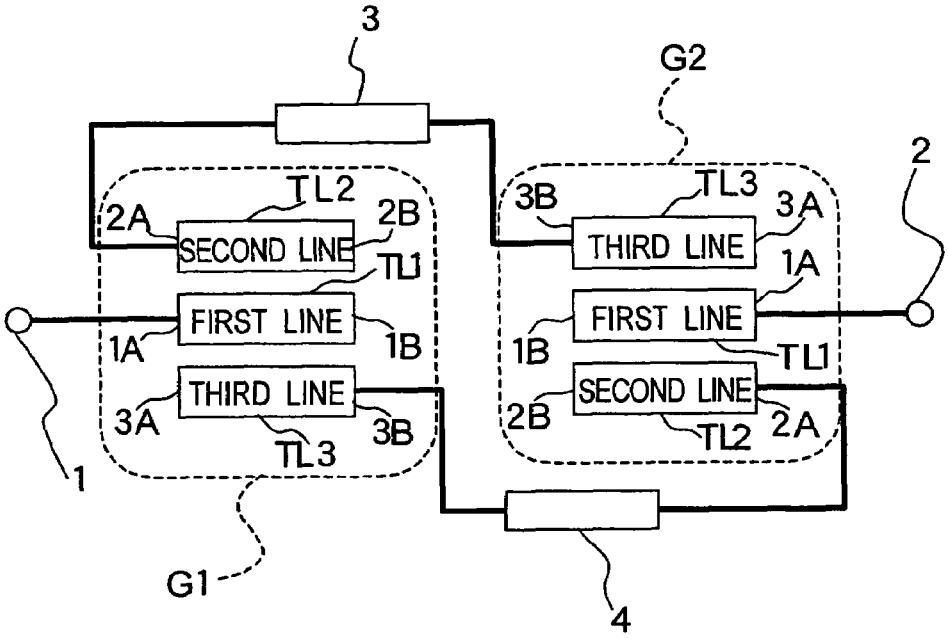
FIG. 1 is a distributed element equivalent circuit diagram showing the construction of a high-frequency filter circuit according to a first embodiment of this invention.

The high-frequency filter circuit and the high-frequency communication device of this invention will be described in detail below on the basis of the embodiments thereof shown in the drawings.

(First Embodiment)

FIG. 1 is a distributed element equivalent circuit that shows by simplification the structure of a high-frequency filter circuit according to the first embodiment of this invention. In FIG. 1, there are shown a first coupled transmission line system G1 and a second coupled transmission line system G2. The first coupled transmission line system G1 is constructed of three high-frequency transmission lines of a first line TL1 that serves as an input side first line, a second line TL2 that serves as an input side second line and a third line TL3 that serves as an input side third line. The second coupled transmission line system G2 is constructed of three high-frequency transmission lines of a first line TL1 that serves as an output side first line, a second line TL2 that serves as an output side second line and a third line TL3 that serves as an output side third line.

The line end 1A of the first line TL1 of the first coupled transmission line system G1 serves as an input port, while the line end 1A of the first line TL1 of the second coupled transmission line system G2 serves as an output port. Moreover, in each of the first coupled transmission line system G1 and the second coupled transmission line system G2, the line end 1B of the first line TL1, the line end 2B of the second line TL2 and the line end 3A of the third line TL3 are open ends. The line end 2A of the second line TL2 of the first coupled transmission line system G1 is connected to the line end 3B of the third line TL3 of the second coupled transmission line system G2 via a phase line 3. The line end 2A of the second line TL2 of the second coupled transmission line system G2 is connected to the line end 3B of the third line TL3 of the first coupled transmission line system G1 via a phase line 4.

A portion extending from the line end 2A of the second line TL2 of the first coupled transmission line system G1 to the line end 3B of the third line TL3 of the second coupled transmission line system G2 via the phase line 3 as well as a portion extending from the line end 2A of the second line TL2 of the second coupled transmission line system G2 to the line end 3B of the third line TL3 of the first coupled transmission line system G1 via the phase line 4 operate roughly as a $\lambda/2$ resonator. That is, a frequency band, in which this $\lambda/2$ resonator causes resonance, serves as the passband of the filter. This high-frequency filter circuit has a point symmetry structure as a whole.

Although the first coupled transmission line system G1 and the second coupled transmission line system G2 have the symmetrical shape of same dimensions in this first embodiment, the systems are not required to have a complete symmetrical shape of same dimensions, and a little modification is based on the principle of the high-frequency filter circuit of this invention.

Figure 2:
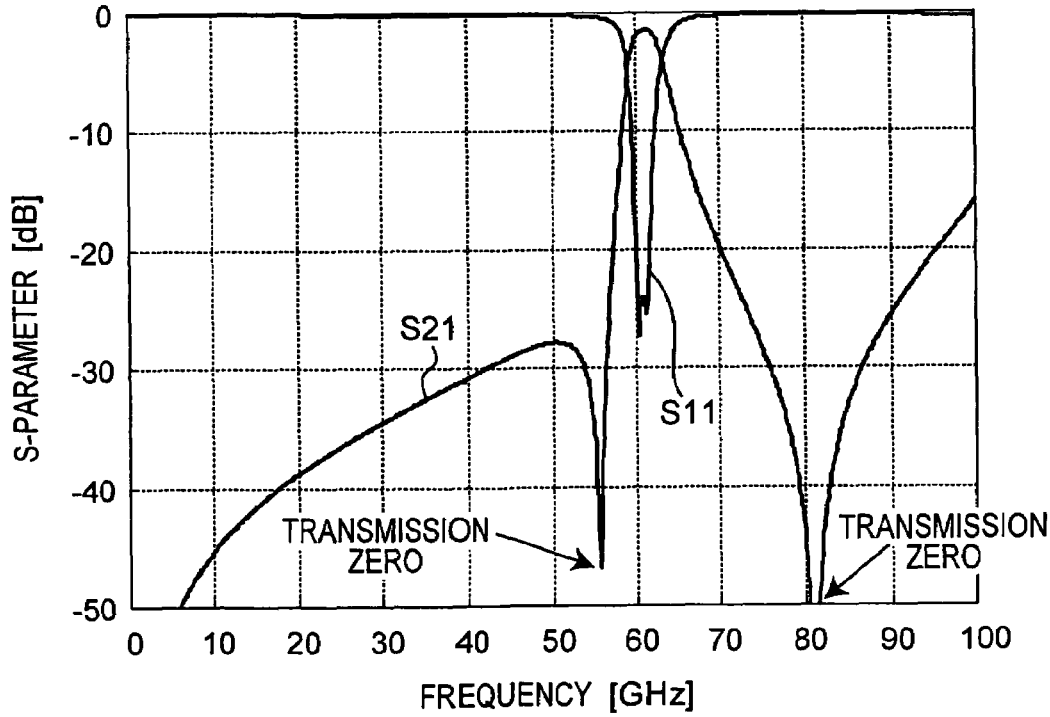
FIG. 2 is a graph of a wide band showing the simulation results of the above high-frequency filter circuit.
Figure 3:
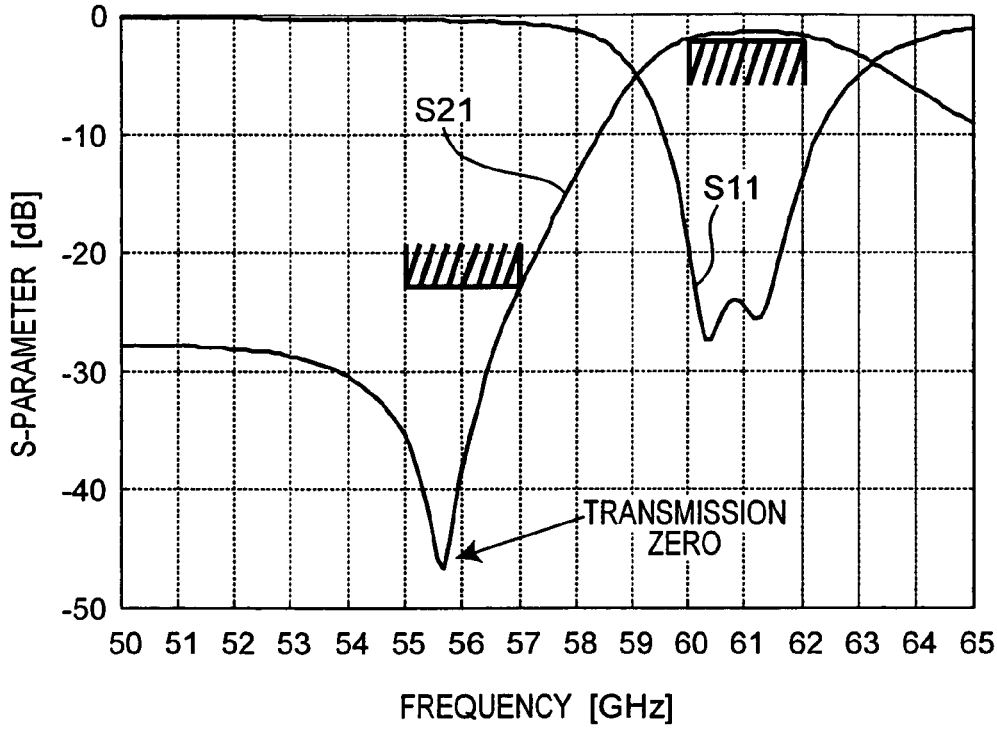
FIG. 3 is a graph in which the portion including the passband and the attenuation band shown in FIG. 2 is enlarged.
Figure 18:
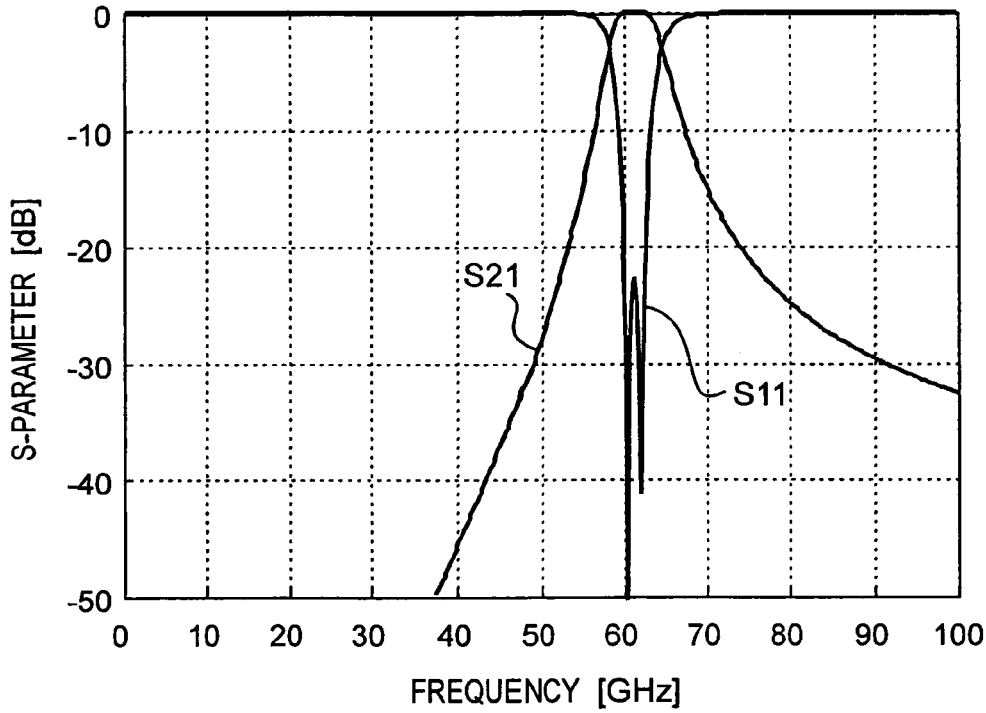
Fig.18 BACKGROUND ART
FIG. 18 is a graph of a wide band showing the simulation results of the equivalent circuit of the above high-frequency filter circuit.
Figure 19:
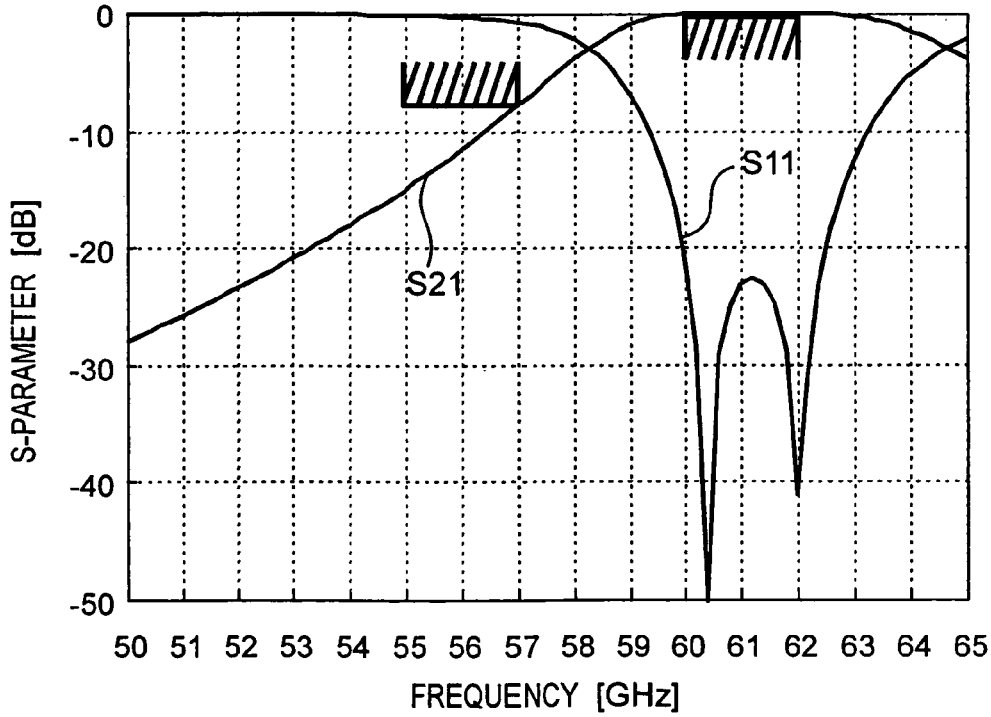
Fig.19 BACKGROUND ART
FIG. 19 is a graph in which the portion of the passband and the attenuation band of FIG. 18 is enlarged.
Figure 20:
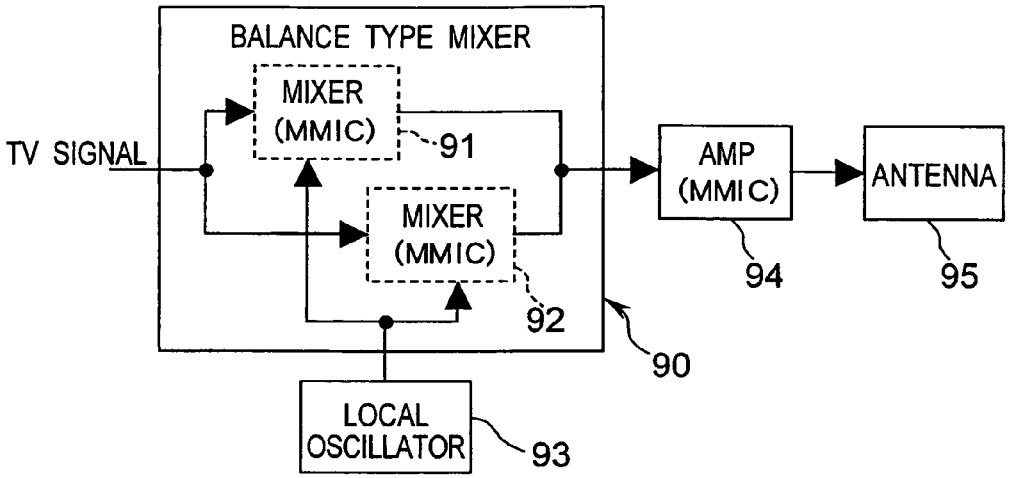
Fig.20 BACKGROUND ART
FIG. 20 is a block diagram showing the construction of a background art high-frequency communication device.
Figure 21:
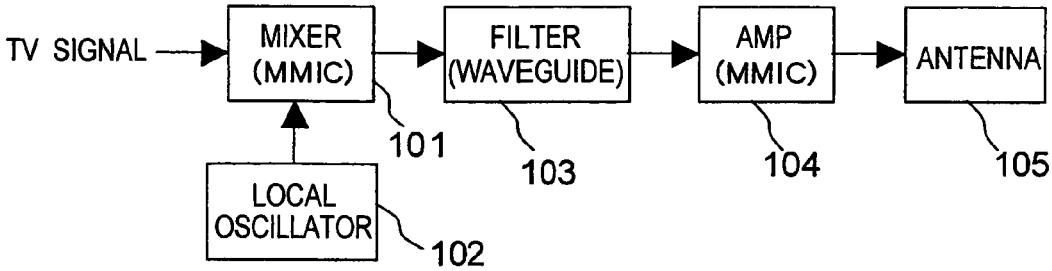
Fig.21 BACKGROUND ART
FIG. 21 is a block diagram showing the construction of another background art high-frequency communication device.

FIGS. 2 and 3 are graphs showing the results of simulating the response characteristics (transmission coefficient S21 and reflection coefficient S11) of the high-frequency filter circuit of FIG. 1 by means of a general high-frequency circuit simulator available on the market. FIG. 2 is a graph of a wide band, and FIG. 3 is a graph in which the portion including the passband and the attenuation band shown in FIG. 2 is enlarged. As is apparent from FIG. 2, a total of two transmission zeros are formed in the vicinity of both sides of the passband with a very simple circuit construction, and it can be understood that the steepness in the vicinity of the passband is remarkably improved in comparison with the prior art high-frequency filter circuit shown in FIGS. 18 and 19. In the graph of FIG. 3, the passband and the attenuation band of the required filter specifications are indicated by the hatched lines on the assumption that the passband has a range of 60 to 62 GHz and the attenuation band (image band) has a range of 55 to 57 GHz similarly to FIG. 19.

The simulation results of FIGS. 2 and 3 are calculated on the parameter conditions as follows. As a high-frequency transmission line to be employed in this high-frequency filter circuit, there is employed a microstrip line formed by patterning 10-$\mu$m thick Au on a dielectric substrate that has a relative permittivity $\epsilon r = 12.9$ and a thickness of 60 $\mu$m. Moreover, with regard to line widths in the first coupled transmission line system G1 and the second coupled transmission line system G2, the first line TL1 has a width of 40 $\mu$m, and the second line TL2 and the third line TL3 have a width of 35 $\mu$m. With regard to gap widths, there is a width of 50 $\mu$m between the first line TL1 and the second line TL2 and a width of 10 $\mu$m between the first line TL1 and the third line TL3. A length from the first line TL1 to the third line TL3 is 200 $\mu$m. Further, the phase line 3 is a line of an impedance of 50 Ω, and a phase rotation angle is 85 degrees at 60 GHz.

Figure 4:
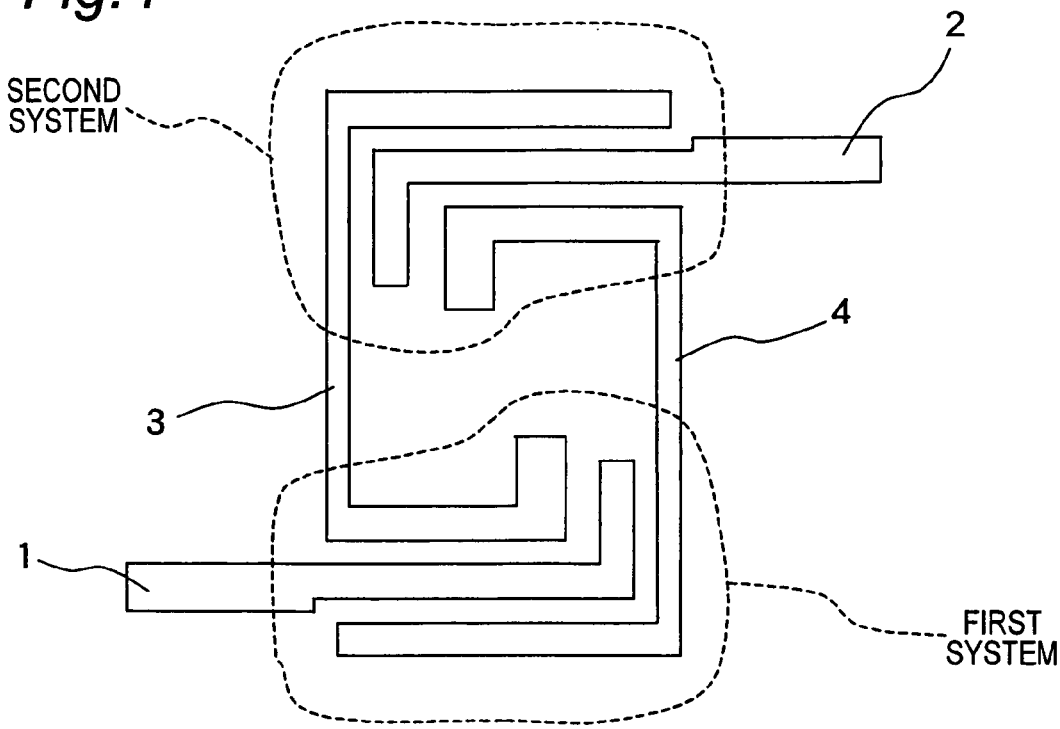
FIG. 4 is a view showing the layout of an experimental sample of the high-frequency filter circuit of the first embodiment of this invention.

FIG. 4 shows the layout of the filter circuit actually produced on an experimental basis with the high-frequency filter circuit shown in FIG. 1 provided as an MMIC circuit on a GaAs substrate.

In the high-frequency filter circuit shown in FIG. 4, the thickness of the GaAs substrate is reduced to a thickness of 60 $\mu$m by abrasion, and a grounding layer is formed by depositing Au on the lower surface. A microstrip line is formed by patterning 10-$\mu$m thick Au on the upper surface of this GaAs substrate. The line spacing of this microstrip line is designed according to mainly a 30-$\mu$m rule and partially to a 20-$\mu$m rule. Only the microstrip line of the input/output port is designed according to a 40-$\mu$m rule of line width for matching to 50 Ω.

In FIG. 4, there are shown an input line 1 whose one end serves as an input port, an output line 2 whose one end serves as an output port, and phase lines 3 and 4. The characteristic impedance of the phase lines 3 and 4 is not necessarily limited to 50 Ω but slightly greater than 50 Ω in the case of this filter produced on an experimental basis. In the case of this filter produced on an experimental basis, the lines of the first coupled transmission line system G1 and the second coupled transmission line system G2 are designed to be not linear but slightly bent for size reduction. As described above, the minor modifications of slightly bending the lines and somewhat changing the line widths do not deviate from the scope of this invention. This is for the reason that neither new electrical function nor property is added to the coupled transmission line systems themselves because, for example, the first coupled transmission line system G1 and the second coupled transmission line system G2 are somewhat bent, and no change occurs in the fact that the systems are based on the principle of the high-frequency filter circuit of this invention disclosed in FIG. 1. As is apparent from FIG. 4, the high-frequency filter circuit of this first embodiment is a very simple circuit that can be formed by the patterning of one layer, and there is included no crossover or the like of interconnection using, for example, an air bridge. Accordingly, this arrangement is able to dispense with simple manufacturing processes and to reduce variation.

According to the layout design of the high-frequency filter circuit shown in FIG. 4, the size of the patterned portion has an area of only 300 μm×490 μm except for the microstrip lines of the input line 1 whose one end serves as the input port and the output line 2 whose one end serves as the output port. Therefore, the patterned lines can easily be formed integrally with the other circuits (amp circuit and mixer circuit) on an MMIC. As described above, there are the following two reasons for the permitted remarkable size reduction of the circuit in comparison with the prior art high-frequency filter circuit. The first reason was that the whole circuit was able to be comfortably folded compact since the two λ/2 resonators are connected not in series but parallel between the input and output ports. The second reason is that the filter circuit is not required to be increased in size with a multi-stage structure since a steep bandpass characteristic can be obtained with the transmission zeros as also shown in the graphs of FIGS. 5 and 6 as follows.

Figure 5:
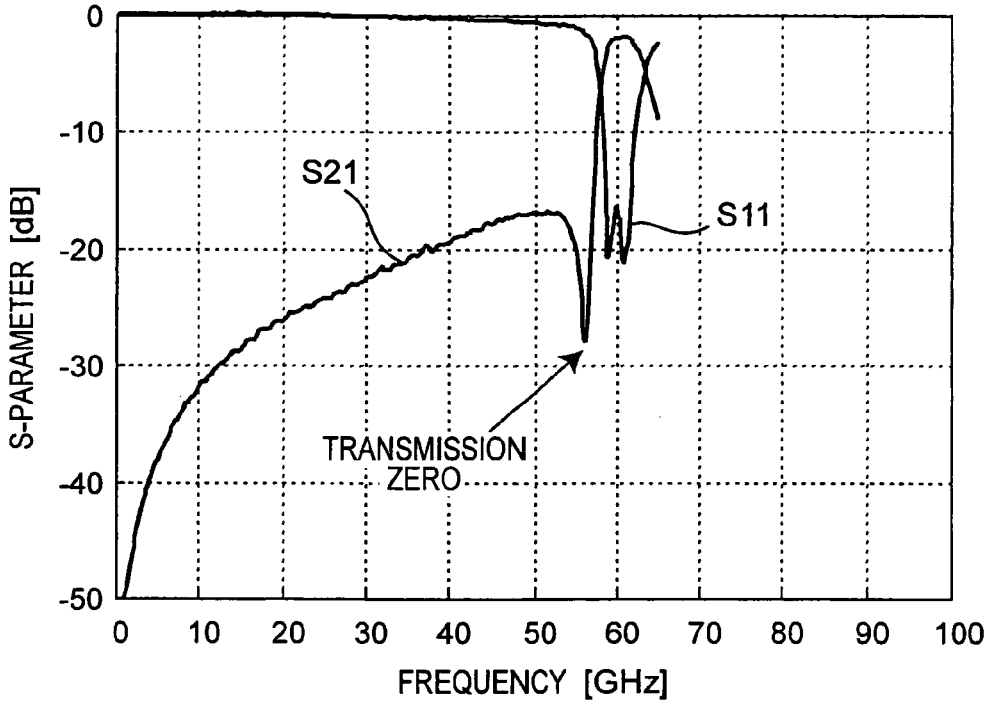
FIG. 5 is a graph of a wide band showing the measurement results of the above experimental sample of FIG. 4.
Figure 6:
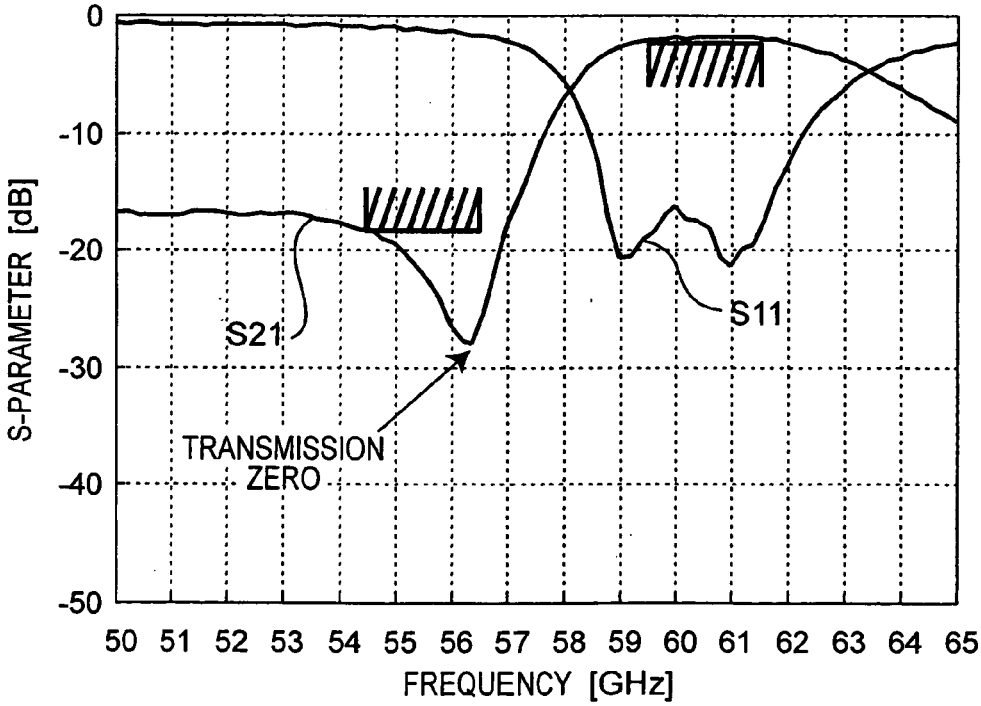
FIG. 6 is a graph in which the portion including the passband and the attenuation band of FIG. 5 is enlarged.

FIGS. 5 and 6 are graphs showing the results of measuring the high-frequency filter circuit of FIG. 4. FIG. 5 shows a graph of a wide band, while FIG. 6 shows a graph in which the portion including the passband and the attenuation band of FIG. 5 is enlarged. According to the measurement method, a GSG (coplanar) probing pad was provided by a via hole technology at the tip of the microstrip lines of the input line 1 and the output line 2 on an MMIC produced on an experimental basis, and the S-parameter was measured by a network analyzer by applying a coplanar high-frequency probe calibrated by LRM (line-reflect-match) to the pad.

According to FIGS. 5 and 6, it was able to be confirmed that the transmission zeros were formed in the vicinity of the passband as estimated by the simulation results of FIGS. 2 and 3 and the steepness was improved by virtue of the transmission zeros although the measurement was able to be achieved up to 65 GHz due to a restriction on the measuring instrument. Moreover, in the case of this high-frequency filter circuit produced on an experimental basis, the insertion loss was 1.9 dB at a minimum. One reason why the insertion loss is reduced as described above is that a parasitic loss such as a conductor loss scarcely intervenes since the two λ/2 resonators are connected not in series but parallel between the input and output ports. Since the center frequency was slightly displaced to the lower frequency side more than intended according to the actual measurement results of the high-frequency filter circuit produced on an experimental basis in FIGS. 5 and 6, the passband of the filter specifications is indicated by the hatched lines while being corrected with a shift toward the lower frequency side in the graph of FIG. 6.

(Second Embodiment)

In the superhigh frequency band like the millimeterwave band, it is desirable to design the high-frequency filter circuit as a complete distributed element circuit as shown in FIG. 4 of the first embodiment. However, it is advantageous in terms of size reduction to partially replace the circuit elements with inductors L and capacitors C of a lumped element in a comparatively low frequency band like the quasi-microwave band. A high-frequency filter circuit in which the high-frequency filter circuit of this invention is partially or totally replaced by a lumped element will be described below.

Figure 7:
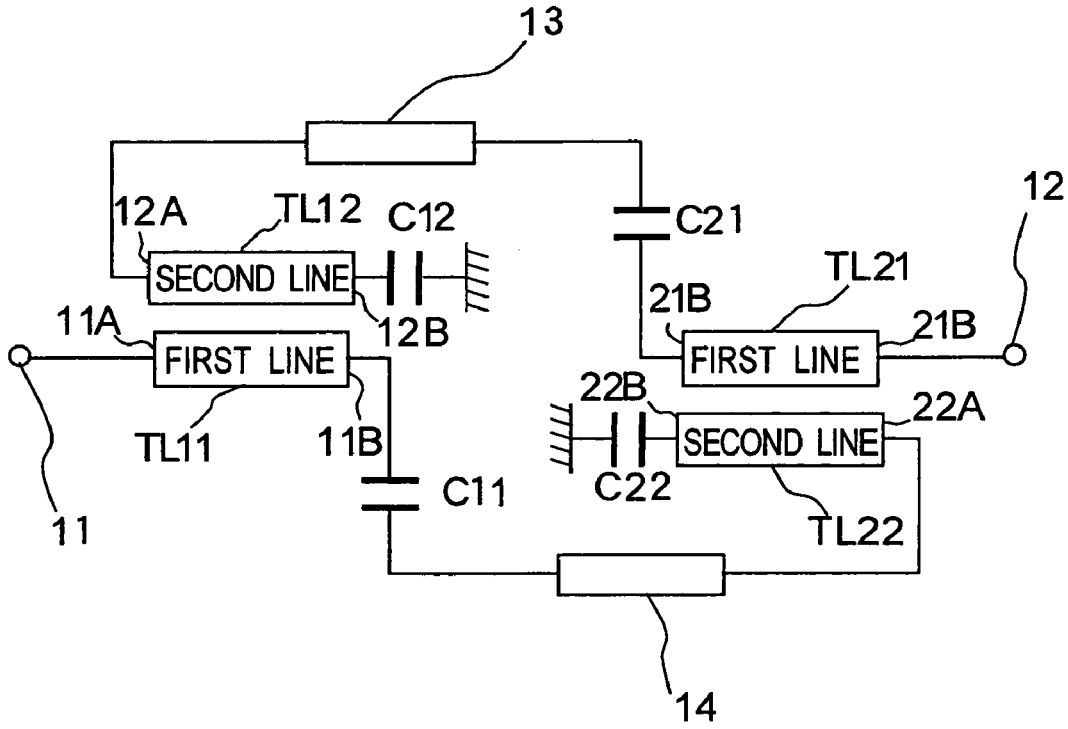
FIG. 7 is an equivalent circuit diagram in which the high-frequency filter circuit according to a second embodiment of this invention is represented by a semi-lumped element.

FIG. 7 is an equivalent circuit diagram showing a high-frequency filter circuit of a semi-lumped element according to the second embodiment of this invention, in which the electromagnetic field coupling between the first line TL1 and the third line TL3 of the high-frequency filter circuit shown in FIG. 1 of the first embodiment are each replaced by a capacitor of a lumped element. It is generally known that, if two microstrip lines having open ends are extended in the opposite directions and located adjacent to each other with the overlap dimension set smaller than λ/4 in the high-frequency filter circuit like the relation between the first line TL1 and the third line TL3 of the high-frequency filter circuit of the first embodiment, then the principal electromagnetic field coupling between these first line TL1 and third line TL3 becomes capacitive coupling.

As shown in FIG. 7, an input port 11 is connected to one line end 11A of a first line TL11, one end of a phase line 13 is connected to one line end 12A of a second line TL12, and the other end of the phase line 13 is connected to the other line end 21B of a first line TL21 via a capacitor C21. An output port 12 is connected to one line end 21A of the first line TL21. One end of a phase line 14 is connected to one line end 22A of the second line TL22, and the other line end 11B of the first line TL11 is connected to the other end of the phase line 14 via a capacitor C11. The other line end 12B of the second line TL12 is connected to the ground via a capacitor C12, and the other line end 22B of the second line TL22 is connected to the ground via a capacitor C22. These capacitors C12 and C22 are parasitic capacitances at the open ends of the lines, which are not shown in FIG. 1. The capacitors C11 and C21 have a capacitance of 0.02003 pF, and the capacitors C12 and C22 have a capacitance of 0.00990 pF.

A first coupled transmission line system is constituted of the first line TL11, the second line TL12 and the capacitor C11, while a second coupled transmission line system is constituted of the first line TL21, the second line TL22 and the capacitor C21. The first line TL11, the second line TL12, the first line TL21 and the second line TL22 are microstrip lines.

Figure 9:
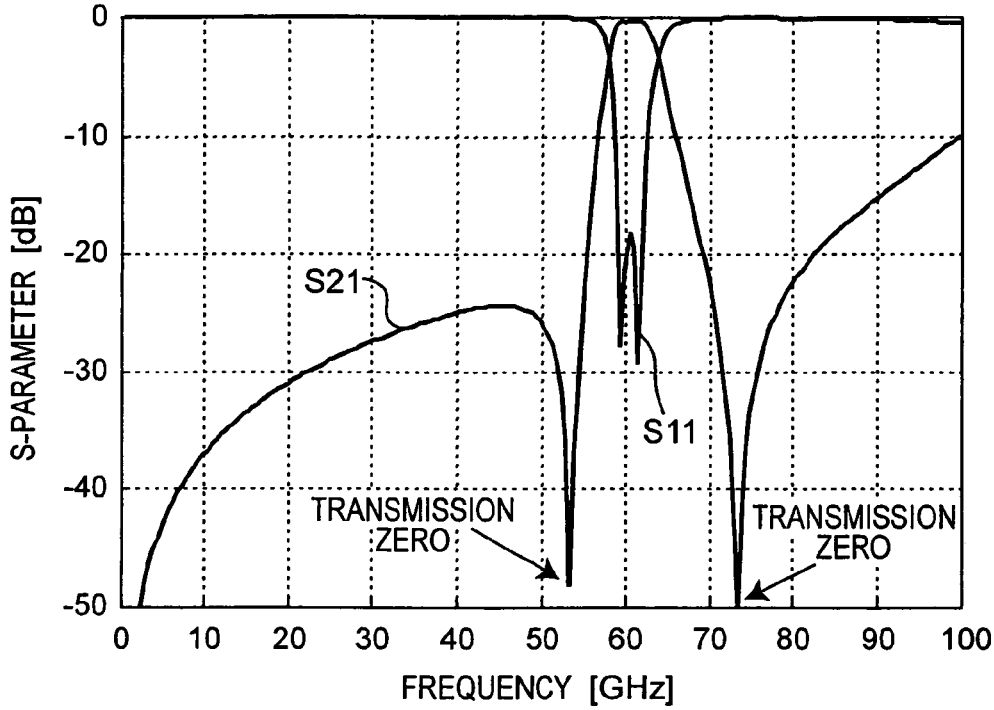
FIG. 9 is a graph showing the simulation results of the high-frequency filter circuit of FIG. 5.

FIG. 9 shows the simulation results of the high-frequency filter circuit of FIG. 7. As shown in FIG. 9, two transmission zeros, which are the features of the high-frequency filter circuit of this invention, appear also in the high-frequency filter circuit of FIG. 7, and a steep filter characteristic is obtained.

The simulation results of FIG. 9 are calculated on the parameter conditions as follows. As a high-frequency transmission line, there was employed a microstrip line in which 10-μm thick Au was formed by patterning on a dielectric substrate that had a relative permittivity $\epsilon r=12.9$ and a thickness of 60 μm. With regard to the line widths, the first lines TL11 and TL21 have a width of 30 μm, and the second lines TL12 and TL22 have a width of 50 μm. A gap width of 30 μm is provided between the first line TL11 and the second line TL12 and between the first line TL21 and the second line TL22. The first lines TL11 and TL21 and the second lines TL12 and TL22 have a length of 215 μm. The phase line 13 is a line of a characteristic impedance of 50 Ω, and the phase rotation angle is 103 degrees at 60 GHz.

Figure 8:
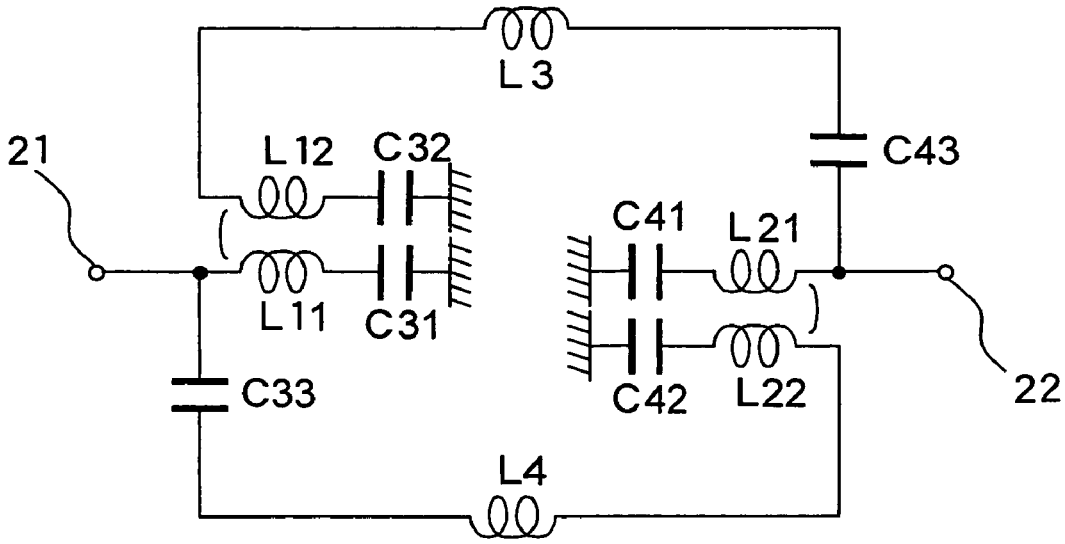
FIG. 8 is an equivalent circuit diagram in which the above high-frequency filter circuit is represented by a complete lumped element.

FIG. 8 shows an equivalent circuit diagram in which the high-frequency filter circuit shown in FIG. 7 of the second embodiment of this invention is represented by a complete lumped element. As shown in FIG. 8, in this high-frequency filter circuit, an input port 21 is connected to one end of an inductor L11, and the other end of the inductor L11 is connected to the ground via a capacitor C31. The other end of an inductor L12 that has mutual inductance with the inductor L11 is connected to the ground via a capacitor C32. One end of an inductor L3 is connected to one end of the inductor L12, and one end of a capacitor C43 is connected to the other end of the inductor L3. The other end of the capacitor C43 is connected to one end of an inductor L21, an output port 22 is connected to one end of the inductor L21, and the other end of the inductor L21 is connected to the ground via a capacitor C41. The other end of an inductor L22 that has mutual inductance with the inductor L21 is connected to the ground via a capacitor C42. One end of an inductor L4 is connected to one end of the inductor L22, and the other end of the inductor L4 is connected to one end of the inductor L11 via a capacitor C33.

The capacitors C33 and C43 correspond to the capacitors C11 and C21, respectively, of FIG. 7. The inductors L11 and L12 correspond to the first line TL11 and the second line TL12, respectively, of FIG. 7, while the inductors L21 and L22 correspond to the first line TL21 and the second line TL22, respectively, of FIG. 7. The capacitors C31, C32, C41 and C42 are parasitic capacitances at the open ends of the lines, which are not shown in FIG. 1. In this case, the inductors L11, L12, L21 and L22 have an inductance of 0.08503 nH, the inductors L3 and L4 have an inductance of 0.18254 nH, and the capacitors C33 and C43 have a capacitance of 0.07484 pF. A coupling coefficient k of the inductors L11 and L12 and a coupling coefficient k of the inductors L21 and L22 are each 0.11042.

In the high-frequency filter circuit of the aforementioned construction, the electromagnetic field coupling between the first line TL1 and the second line TL2 of the first and second coupled transmission line systems G1 and G2 of FIG. 1 is replaced by a mutual inductance of a lumped element in order to more completely represent the high-frequency filter circuit of FIG. 7 by a lumped element. Further, the phase lines 13 and 14 shown in FIG. 7 are also replaced by the inductors L3 and L4 of a lumped element in this high-frequency filter circuit.

Figure 10:
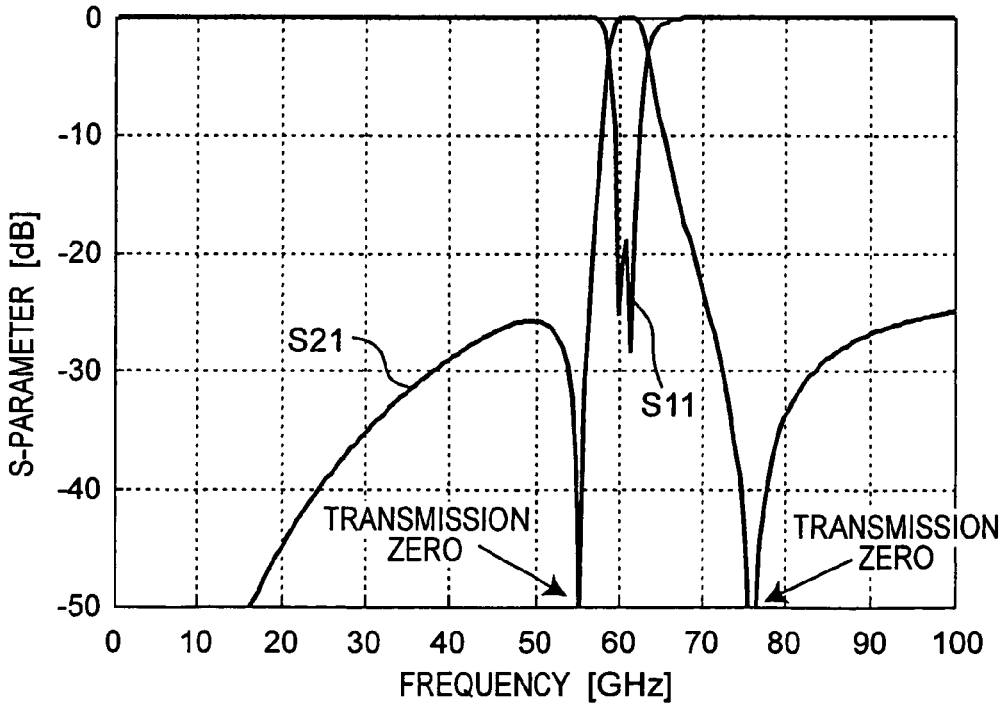
FIG. 10 is a graph showing the simulation results of the high-frequency filter circuit of FIG. 8.

FIG. 10 shows the simulation results of this high-frequency filter circuit. As shown in FIG. 10, two transmission zeros, which are the features of the high-frequency filter circuit of this invention, appear also in the high-frequency filter circuit of FIG. 8, and a steep filter characteristic is obtained.

(Third Embodiment)

As described above, the high-frequency filter circuit of this invention is based on the distributed element equivalent circuit shown in FIG. 1. However, the actual layout has a degree of freedom as described with reference to FIG. 4, and various designs can further be considered if partial replacement with the lumped elements is achieved as described with reference to FIG. 7 and FIG. 8. Concrete examples are shown in FIG. 11 through FIG. 13.

Figure 11:
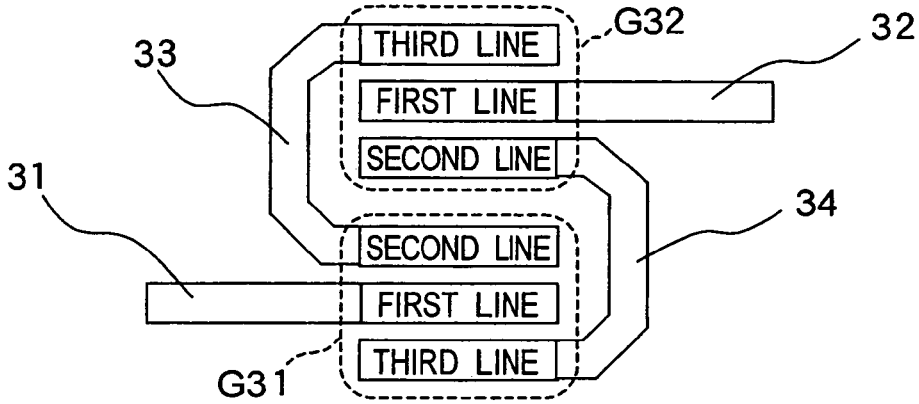
FIG. 11 is a view showing the layout of a high-frequency filter circuit according to a third embodiment of this invention.

FIG. 11 is a layout example in which the first coupled transmission line system and the second coupled transmission line system are arranged in a direction (vertical direction in FIG. 11) perpendicular to the first through third lines. In particular, this arrangement is effective when a layout is desired to be provided by shrinking the dimension in the lengthwise direction (horizontal direction in FIG. 11) of the first through third lines. In FIG. 11, there are shown an input port 31, an output port 32, a phase line 33, a phase line 34, a first coupled transmission line system G31 and a second coupled transmission line system G32.

Figure 12:
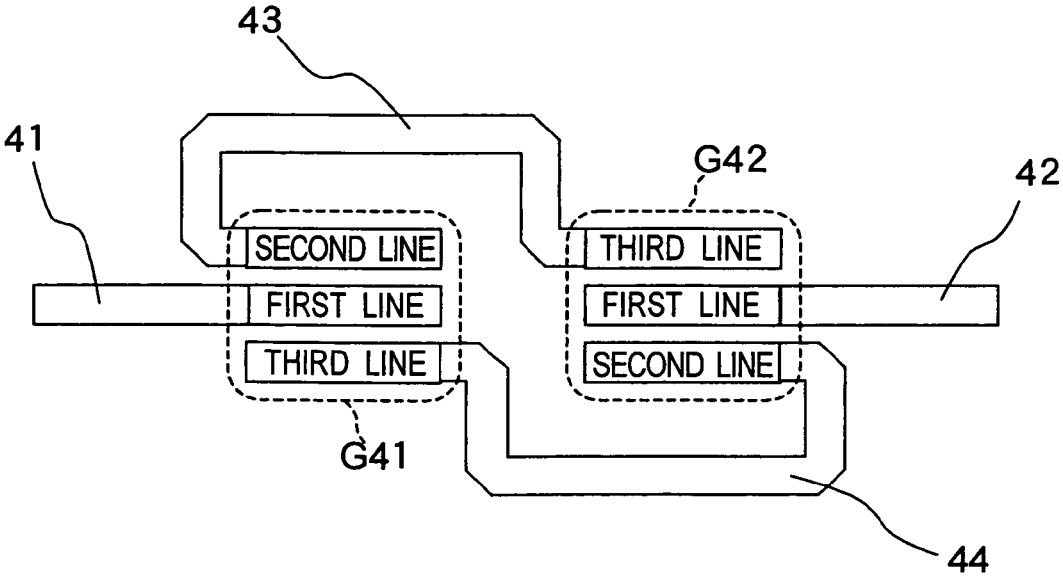
FIG. 12 is a view showing another layout of a high-frequency filter circuit according to a third embodiment of this invention.

FIG. 12 shows a layout in the case where the first coupled transmission line system and the second coupled transmission line system are arranged in the lengthwise direction (horizontal direction in FIG. 11) of the first through third lines. In particular, this arrangement is effective when a layout is desired to be provided by shrinking the dimension in the direction (vertical direction in FIG. 11) perpendicular to the first through third lines. In FIG. 12, there are shown an input port 41, an output port 42, a phase line 43, a phase line 44, a first coupled transmission line system G41 and a second coupled transmission line system G42.

Figure 13:
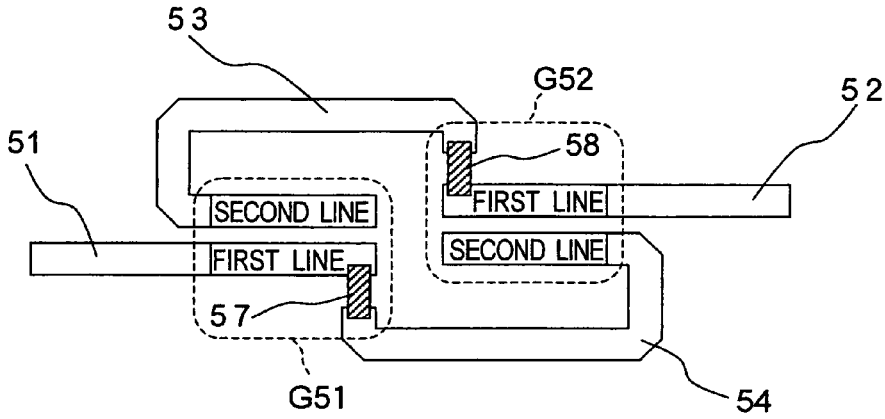
FIG. 13 is a view showing another layout of a high-frequency filter circuit according to a third embodiment of this invention.

FIG. 13 shows a layout in the case where the capacitor of FIG. 8 as a lumped element is adopted. In FIG. 13, there are shown an input port 51, an output port 52, a phase line 53, a phase line 54, a first coupled transmission line system G51 and a second coupled transmission line system G52. In FIG. 13, the capacitors C11 and C21 in FIG. 7 are provided by chip capacitors 57 and 58, respectively, while the capacitors C12 and C22 in FIG. 7 are provided by the open ends of the respective second lines of the first and second coupled transmission line systems G51 and G52.

(Fourth Embodiment)

In FIG. 1, if the amount of mutual electromagnetic field coupling is kept appropriate in the coupled transmission line system constructed of the three high-frequency transmission lines, there is a certain degree of freedom in the structure. For example, the three lines are not required to be in an identical plane, and the order of the three high-frequency transmission lines may be changed. Moreover, the high-frequency transmission line is not necessarily limited to the microstrip line but allowed to be a coplanar line.

Figure 14A:
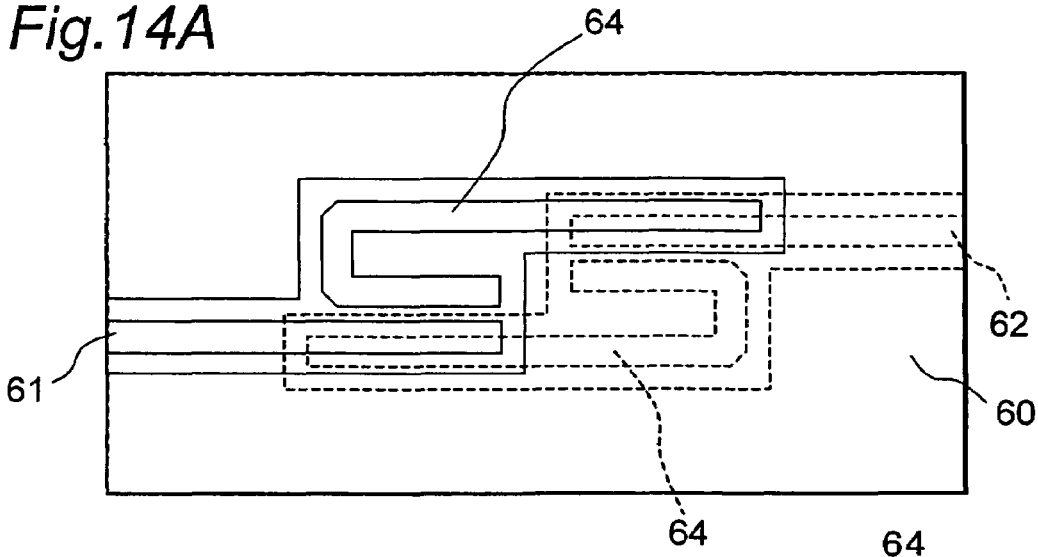
FIG. 14A is a perspective view of the substrate of a high-frequency filter circuit according to a fourth embodiment of this invention.
Figure 14B:
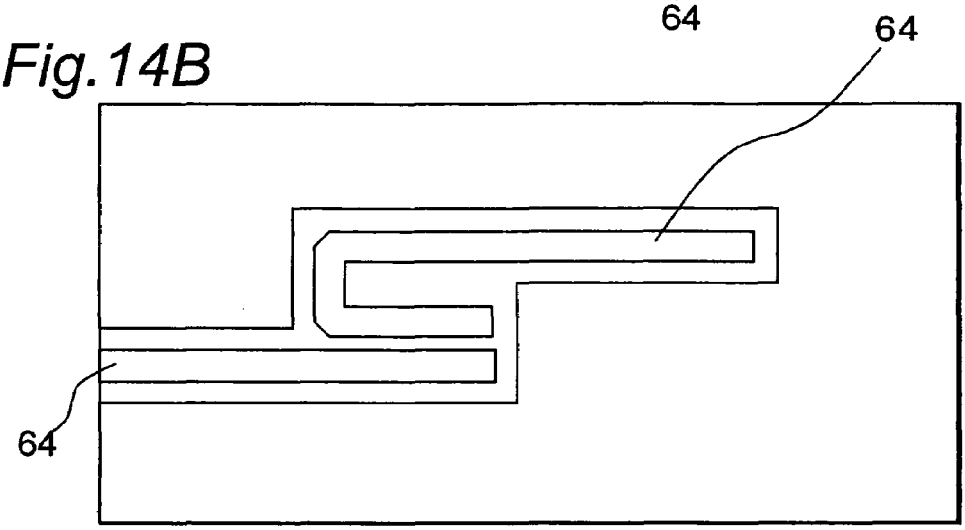
FIG. 14B is a view showing the pattern on the upper side of the substrate.
Figure 14C:
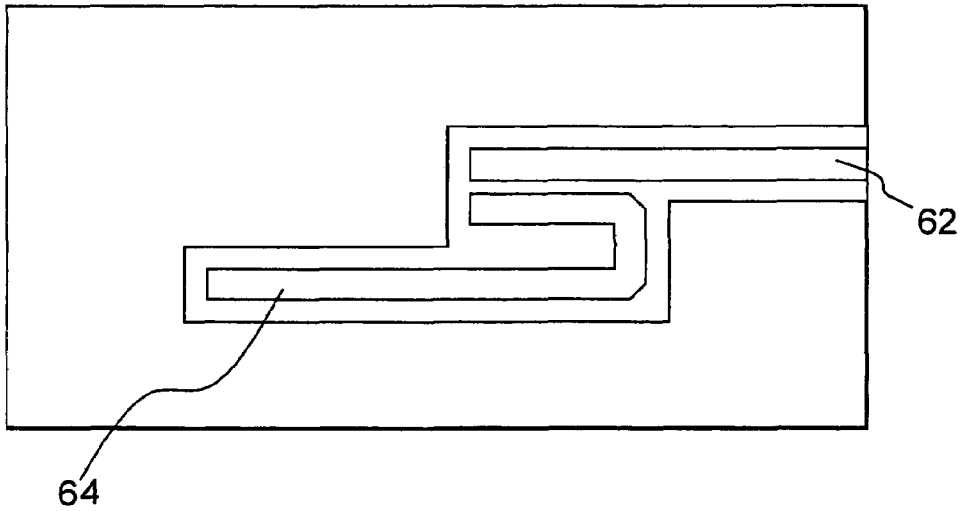
FIG. 14C is a view showing the pattern on the lower side of the substrate.

FIGS. 14A through 14C show modification examples of the structure of the high-frequency filter circuit described above. FIG. 14A is a perspective view of a substrate 60 of which the upper and lower surfaces are aligned with each other. FIG. 14B shows the pattern on the upper side of the substrate. FIG. 14C shows the pattern on the lower side of the substrate. As shown in FIG. 14A, a double-sided coppered board 60 of Teflon (registered trademark) or the like is employed, with half the circuit arranged on the upper side of the substrate 60 and the remaining half arranged on the lower side of the substrate 60. Moreover, a coplanar line is employed as a high-frequency transmission line. In FIG. 14A, there are shown an input port 61, an output port 62 and a $\lambda/2$ resonator 64. In FIGS. 14A through 14C, the electromagnetic field coupling between the first line TL1 and the third line TL3 in FIG. 1 is provided as electromagnetic field coupling between the upper surface and the lower surface of the board.

(Fifth Embodiment)

As shown in the high-frequency filter circuit of FIG. 4 produced on an experimental basis, one feature of the filter technique of this invention is that it allows an MMIC to be produced within a size of only about 400 to 500 $\mu$m square in the millimeterwave band. Moreover, in the above case, a wide bandwidth of up to 2 to 3 GHz can easily be secured with regard to the passband and the attenuation band (image band) as corroborated by the measurement results of FIGS. 5 and 6. The above feature is the feature very suitable for a multi-channel TV signal transmission system reported in the reference document of K. Hamaguchi et al., "A Wireless Video Home-Link Using 60 GHz Band: A Concept of Developed System", Proc. of EuMC, vol.1, pp.293–296, 2000".

According to the high-frequency filter circuit of this invention, the bandwidth of 2 to 3 GHz can be easily secured in the 60-GHz band, and other circuits (amp circuit and so on) can easily be integrated on an identical chip because the filter circuit itself is small.

Moreover, according to the high-frequency filter circuit of this invention, it is easy to form the filter circuit integrally with the amp circuit and the mixer circuit located before and behind the circuit on an MMIC, and the filter itself is produced at low cost, subminiature and ultralight.

Figure 15:
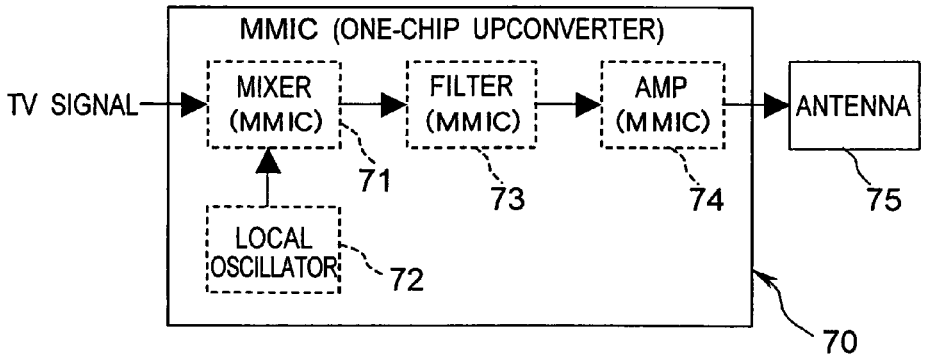
FIG. 15 is a block diagram showing the construction of a millimeterwave band communication device as a high-frequency communication device according to a fifth embodiment of this invention.
Figure 16:
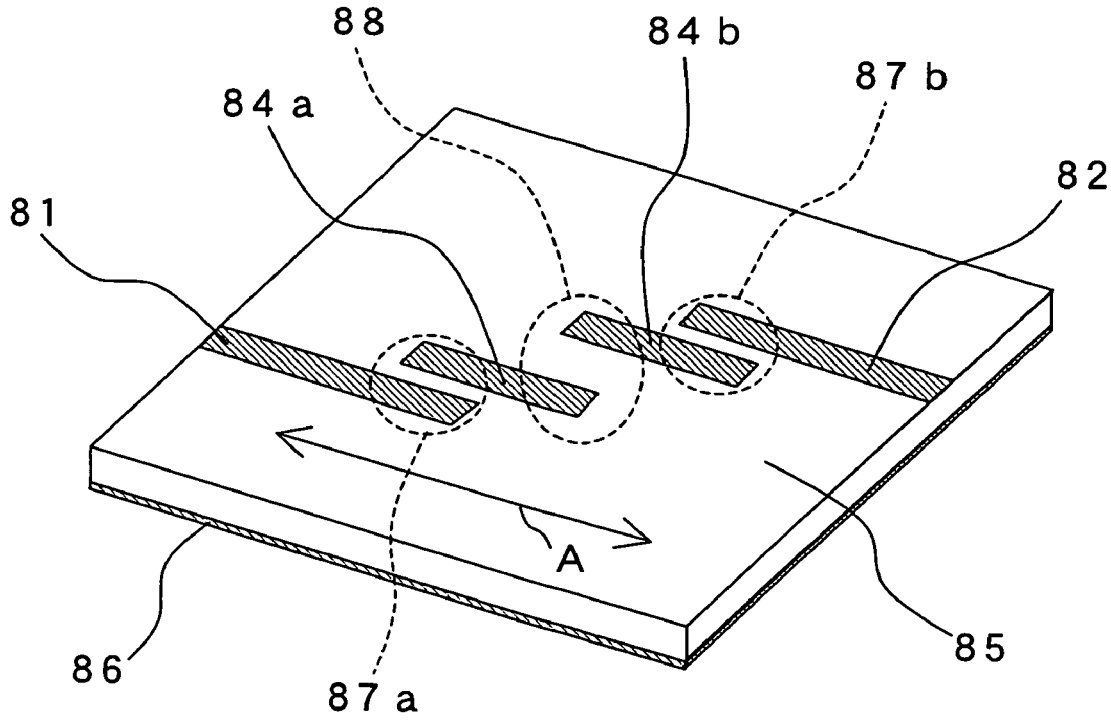
Fig.16 BACKGROUND ART
FIG. 16 is a perspective view of a background art high-frequency filter circuit.
Figure 17:
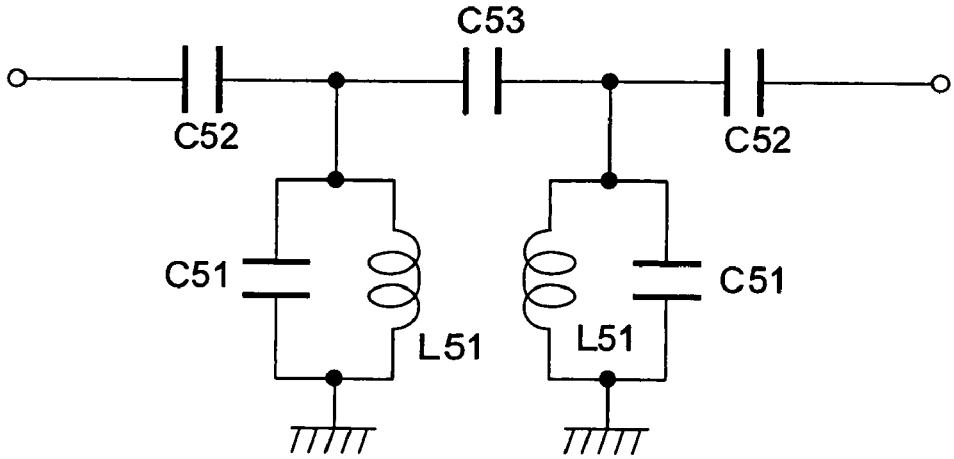
Fig.17 BACKGROUND ART
FIG. 17 is the equivalent circuit of the above high-frequency filter circuit.

FIG. 15 is a block diagram showing the construction of a millimeterwave-band communication device that is the transmission circuit of the system of the aforementioned reference document as the high-frequency communication device that employs the high-frequency filter circuit of this invention. As shown in FIG. 15, this millimeterwave-band communication device is provided with a mixer 71 into which a TV signal is inputted, a local oscillator 72 that supplies a local signal to the mixer 71, a filter 73 that effects the image rejection of the signal outputted from the mixer 71, an amp 74 that amplifies the signal outputted from the filter 73 and an antenna 75 to which the output of the amp 74 is connected. There is provided a one-chip upconverter MMIC 70 in which the mixer 71, the local oscillator 72, the filter 73 and the amp 74 are all formed on an identical chip. It is also acceptable to divide the MMIC into MMIC's of about two chips for the convenience of manufacturing and design.

Since the entire system can easily be formed into an MMIC, there can be obtained the synergistic effects of not only the reductions in cost, scale and weight of the single unit of the filter circuit but also the remarkable simplification of the entire system, the reduction of parts count and the simplification of the manufacturing processes.

What is claimed is:

1. A high-frequency filter circuit comprising:

a first coupled transmission line section having an input side first line whose one line end serves as an input port and an other line end serves as an open end, an input side second line and an input side third line, which are arranged on either side of the input side first line; and a second coupled transmission line section having an output side first line whose one line end serves as an output port and an other line end serves as an open end, an output side second line and an output side third line, which are arranged on either side of the output side first line, the input side second line having an open end at a line end located on same side as that of the open end side of the input side first line, the input side third line having an open end at a line end located on same side as that of the input port side of the input side first line, the output side second line having an open end at a line end located on same side as that of the open end side of the output side first line, the output side third line having an open end at a line end located on same side as that of the output port side of the output side first line, a line end located on the input port side of the input side second line of the first coupled transmission line section being connected to a line end located on the side opposite from the output port side of the output side third line of the second coupled transmission line section, and a line end located on the output port side of the output side second line of the second coupled transmission line section being connected to a line end located on the side opposite from the input port side of the input side third line of the first coupled transmission line section.

2. The high-frequency filter circuit as set forth in claim 1, wherein at least one of an electromagnetic field coupling between the input side first line and the input side second line of the first coupled transmission line section and an electromagnetic field coupling between the output side first line and the output side second line of the second coupled transmission line section is provided by a mutual inductance.

3. The high-frequency filter circuit as set forth in claim 1, wherein at least one of the connection for connecting the line end located on the input port side of the input side second line of the first coupled transmission line section to the line end located on the side opposite from the output port side of the output side third line of the second coupled transmission line section and the connection for connecting the line end located on the output port side of the output side second line of the second coupled transmission line section to the line end located on the side opposite from the input port side of the input side third line of the first coupled transmission line section is provided by an inductance.

4. A high-frequency communication device, wherein the high-frequency filter circuit as set forth in claim 1 is formed integrally with another circuit as an image rejection filter on an MMIC.

5. A high-frequency communication device, wherein the high-frequency filter circuit as set forth in claim 2 is formed integrally with another circuit as an image rejection filter on an MMIC.

6. A high-frequency communication device, wherein the high-frequency filter circuit as set forth in claim 3 is formed integrally with another circuit as an image rejection filter on an MMIC.

* * * * *